US010718493B2

(12) United States Patent
Xue et al.

(10) Patent No.: US 10,718,493 B2
(45) Date of Patent: Jul. 21, 2020

(54) ANGLE-ADJUSTABLE LAMP

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Yuanfang Xue, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/543,479

(22) Filed: Aug. 16, 2019

(65) Prior Publication Data

US 2020/0056762 A1 Feb. 20, 2020

(30) Foreign Application Priority Data

Aug. 17, 2018 (CN) ..... 2018 1 0945239

(51) Int. Cl.
*F21V 14/02* (2006.01)
*F21V 21/30* (2006.01)

(52) U.S. Cl.
CPC ..... *F21V 14/02* (2013.01); *F21V 21/30* (2013.01)

(58) Field of Classification Search
CPC ..... F21V 14/02; F21V 21/30
USPC ..... 362/372
See application file for complete search history.

(56) References Cited

U.S. PATENT DOCUMENTS 5,904,415 A * 5/1999 Robertson ..... F21V 19/008 362/217.16
7,025,479 B2 * 4/2006 Wardenburg ..... F21S 8/04 362/285
7,052,171 B1 * 5/2006 Lefebvre ..... F21K 9/65 362/649
7,311,423 B2 * 12/2007 Frecska ..... F21S 8/04 362/150
8,157,408 B2 * 4/2012 Yang ..... F21K 9/65 362/217.12
2009/0122543 A1 * 5/2009 Kuo ..... F21V 14/02 362/240
2009/0159919 A1 * 6/2009 Simon ..... F21V 14/02 257/99
2011/0085335 A1 * 4/2011 Osawa ..... F21V 19/02 362/249.14
2011/0194296 A1 * 8/2011 Chou ..... F21K 9/65 362/362
2012/0069583 A1 * 3/2012 Wang ..... F21V 21/30 362/372

(Continued)

*Primary Examiner* — Bryon T Gyllstrom
(74) *Attorney, Agent, or Firm* — Wang Law Firm, Inc.

(57) ABSTRACT

The invention relates to an angle-adjustable lamp, comprising a lamp body, a threading cylinder located at an end of the lamp body and extending axially along the lamp body, and an angle adjusting mechanism, the angle adjusting mechanism comprises a mounting base rotatable mounted on the threading cylinder relative to the lamp body, an elastic piece which can rotate synchronously with the mounting base relative to the lamp body, and an outer end cover which is arranged on the threading cylinder and fixedly connected with the lamp body. Compared with the existing technology, the device provided in the present invention has the advantages of simple assembly structure, short time consumption and production cost-saving.

8 Claims, 5 Drawing Sheets

(56) References Cited

U.S. PATENT DOCUMENTS

| | | | | |
|---|---|---|---|---|
| 2013/0077296 | A1* | 3/2013 | Goeckel | F21V 7/00 362/217.07 |
| 2013/0250565 | A1* | 9/2013 | Chiang | F21V 19/008 362/217.17 |
| 2017/0175953 | A1* | 6/2017 | Van Boven | F21K 9/65 |

* cited by examiner

ANGLE-ADJUSTABLE LAMP

RELATED APPLICATION

This application claims priority to a Chinese Patent Application No. CN 201810945239.4, filed on Aug. 17, 2018.

FIELD OF THE TECHNOLOGY

The present invention relates to lighting field, with particular emphasis on an angle-adjustable lamp.

BACKGROUND OF THE INVENTION

Lighting fixtures are used more and more widely in daily life. With the change of people's needs, the structure of lamps is constantly improving.

For example, the patent CN205807043U "An Angle adjusting mechanism for an LED Strip Lamp" discloses a angle adjusting mechanism for lamps, which comprises an end cover at both ends of the lamp body, and the end cover is provided with a threading cylinder extending along the axial direction of the lamp body. The threading cylinder is provided with a lamp holder and a gear, wherein the edge of the gear is accommodated in the opening of the lamp holder, the teeth of the gear are matched with the limiting teeth on the limiting plate, and the limiting plate is located in the outer end cover. When the lamp holder is rotated, the gear will rotate under the driving of the lamp holder, and the limiting plate will be deformed by the force of the gear, thereby changing the position where it meshes with the gear and limiting the lamp body at the current angle, thereby realizing that the emitting light angle is adjustable.

Although this kind of structure can meet the adjustment of different light-emitting angles, since the limiting plate and the gear are separate components, the steps in the assembly increase and the assembly takes a long time. Meanwhile, since the limiting plate is located in the chute of the outer end cover, it is easy to fall off from the chute due to vibration or the like, causing cooperation with the gear being unable to be effectively realized, thereby affecting the dimming effect.

BRIEF SUMMARY OF THE INVENTION

The object of the present invention is to provide a lamp with an integrated design of the angle adjustment mechanism, a simple assembly structure, a good cooperation degree of the angle adjustment mechanism, and convenient adjustment.

Angle-adjustable lamp, comprising a lamp body, a threading cylinder located at an end of the lamp body and extending axially along the lamp body, and an angle adjusting mechanism, characterized in that:

the angle adjusting mechanism comprises a mounting base rotatable mounted on the threading cylinder relative to the lamp body, an elastic piece which can rotate synchronously with the mounting base relative to the lamp body, and an outer end cover which is arranged on the threading cylinder and fixedly connected with the lamp body;

the upper end surface of the elastic piece is provided with a limiting part, the inner wall of the outer end cover is provided with a gear which is matched with the limiting part when the mounting base rotates relative to the lamp body to maintain the lamp body at a required angle.

Advantageously, the elastic piece comprises a elastic piece body, an annular part connected to the elastic piece body and sleeved on the threading cylinder, and the mounting base is sleeved on the periphery of the annular part;

Advantageously, a braking part is formed between the contact surfaces of the mounting base and the annular part, and under the action of the braking part, the elastic piece can rotate synchronously with the mounting base relative to the lamp body. In this way, the elastic piece can be rotated along with the annular part, and the elastic piece is designed to be sleeved on the threading cylinder, which effectively realizes the fixing of the elastic piece and overcomes the problem that the elastic piece is easily slipped from the assembly component.

In order to simplify the design of the braking part, reduce the production cost, and better exert the function of the braking part, advantageously, the mounting base is sleeved with the annular part through a through hole arranged thereon, the inner wall of the through hole is partially planar, and the corresponding position of the periphery of the annular part is correspondingly planar and the plane of the inner wall of the described through hole is fitted to the plane of the periphery of the annular part to form the braking part.

In order to make the matching effect between the gear and the elastic piece better and maintain the adjustment angle of the lamp body, advantageously, the teeth of the gear are formed along the axial direction of the lamp body and circumferentially distributed on the inner wall of the outer end cover.

In order to make it convenient for the elastic piece to smoothly change the contact position between the teeth of the gear when the mounting base rotates, advantageously, the surface of the limiting part of the elastic piece is an arc surface.

Advantageously, the elastic piece body comprises a smoothly transitioning curved surface and an arched surface smoothly connected to the curved surface, and the limiting part is formed by the outward protrusion of the surface of the arched surface.

Advantageously, the lower part of the outer end cover is formed with a penetrating strip groove formed along the circumferential direction of the outer end cover, and the mounting base is an L-shaped plate body, and the lower end of the L-shaped plate body projects from the strip groove.

Advantageously, the lower part of the threading cylinder is formed with a curved plate, the lower end surface of the housing of the outer end cover is not closed, and when the outer end cover is covered on the threading cylinder, the lower end surface of the housing coincides with both end surfaces of the curved plate to form a complete closed surface.

Compared with the prior art, the advantages of the present invention are as follows: the gear is arranged on the inner wall of the outer end cover, and the elastic piece is fixed by sleeve connection between the annular part and the threading cylinder to realize the integration of the angle adjusting mechanism, thereby avoiding the problems such as the fragmentation caused by excessive parts, inconvenient assembly, and time consuming; meanwhile, the elastic piece is sleeved on the threading cylinder, and the gear is integrally formed on the inner wall of the outer end cover, thereby ensuring the fixing of the position of the components, so that the cooperation between the angle adjustment structures is more stable and firm, thereby ensuring a good dimming effect.

BRIEF DESCRIPTION OF THE DRAWINGS

The drawings described herein are intended to promote a further understanding of the present invention, as follows.

DETAILED DESCRIPTION OF THE INVENTION

Figure 1:
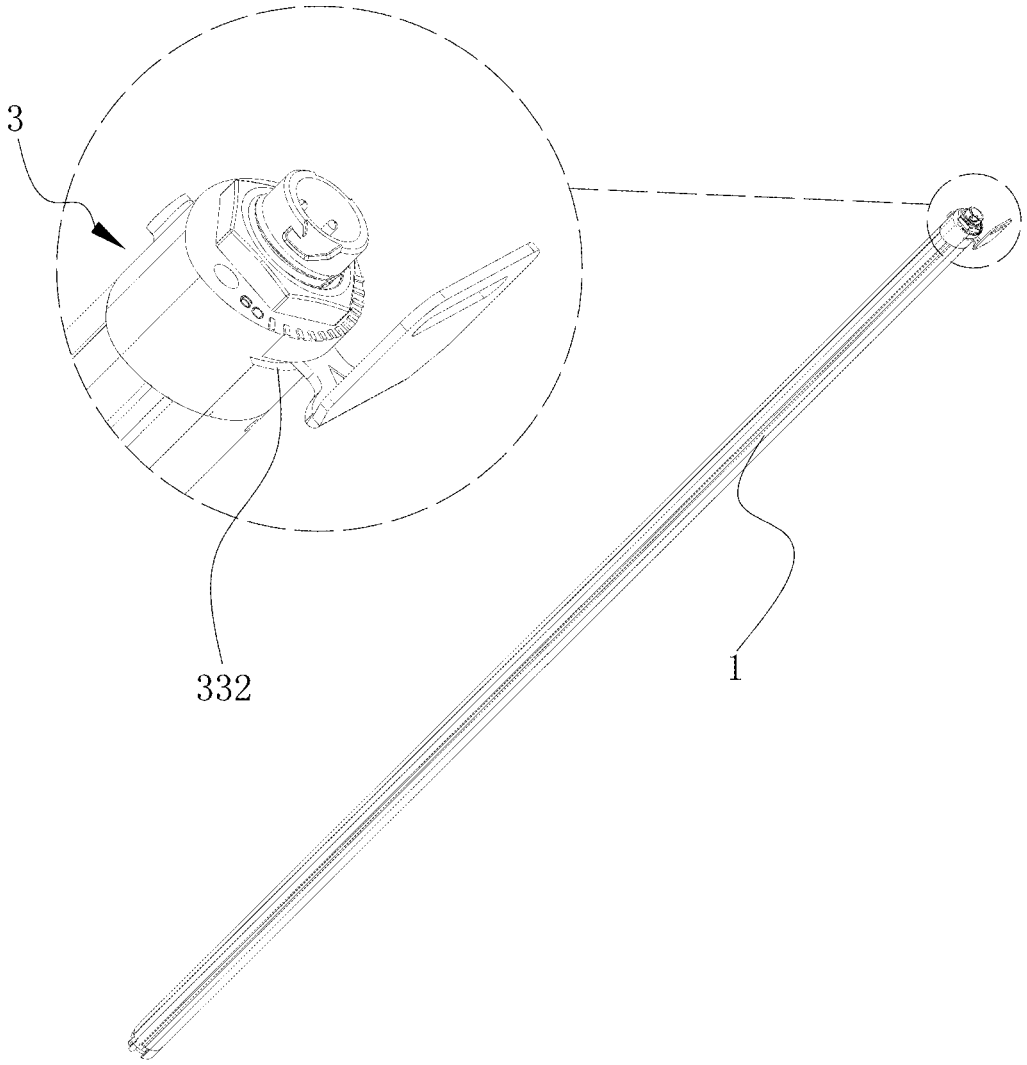
FIG. 1 is a structural diagram of an embodiment of an angle-adjustable lamp in the present invention.

The embodiments of the present invention are described in detail below, and the examples of the described embodiments are illustrated in the drawings, where the identical or similar labels throughout represent identical or similar elements or elements with the identical or similar functions. The embodiments described below with reference to the accompanying drawings are illustrative, which are intended only to explain the present invention, but not to be understood as limitations to the present invention.

FIGS. 1-4 illustrate an embodiment of an angle-adjustable lamp in the present invention. The angle-adjustable lamp comprises a lamp body 1, a threading cylinder 2 located at an end of the lamp body 1 and extending axially along the lamp body 1, and an angle adjusting mechanism 3. The lamp body 1 is a strip lamp in this embodiment. Of course, the lamp not only comprises the above components, but also other modules such as power supply, circuit board, wire, LED chip, etc., and these modules are housed in the lamp body 1, so the design is beautiful and characterized by convenient transportation and simple assembly. However, this technology is well known to those skilled in the art and is not the focus of the present invention, and therefore will not be described herein.

Figure 2A:
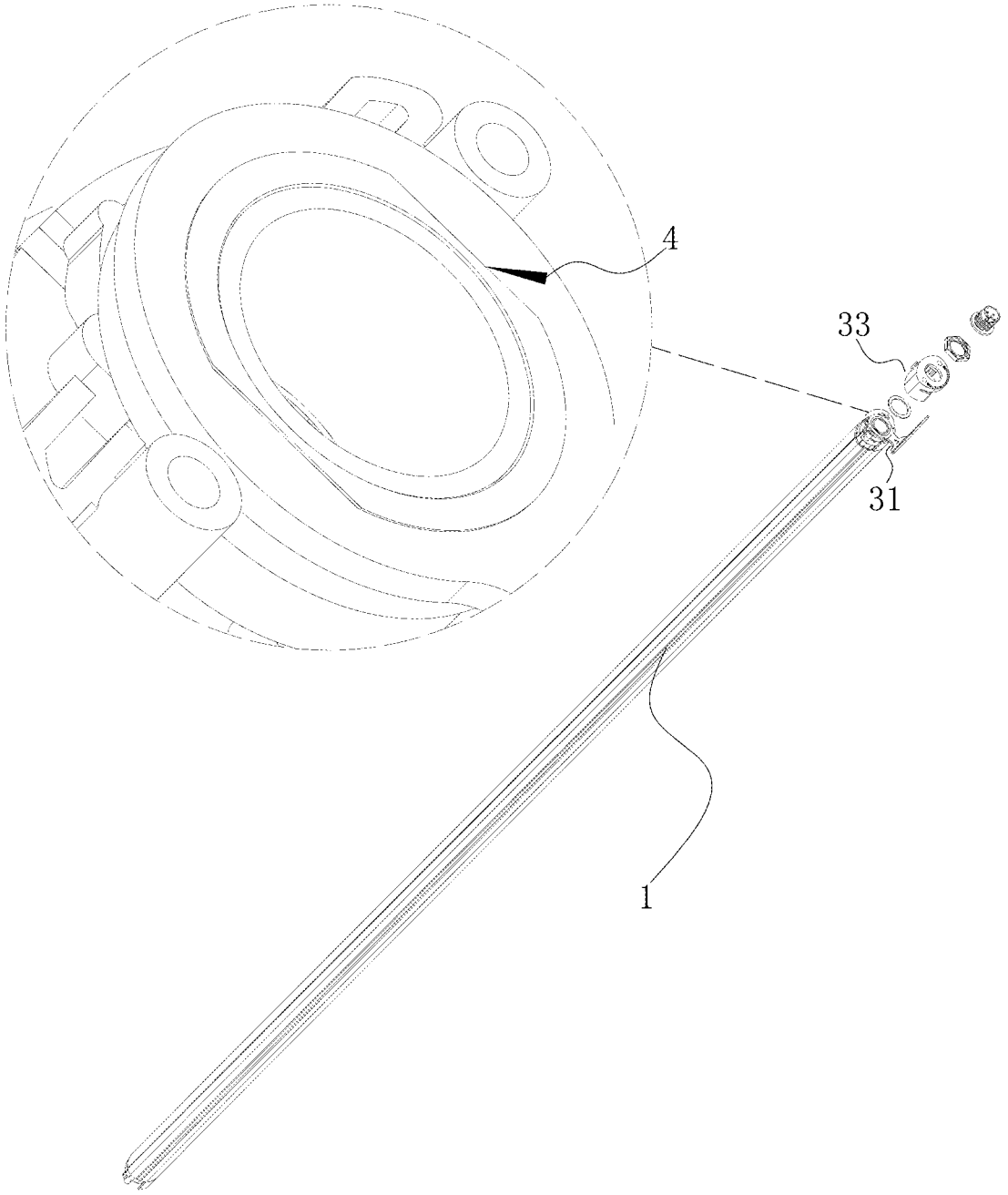
FIG. 2(*a*) and FIG. 2(*b*) are respectively different partial decomposition diagrams of FIG. 1.
Figure 2B:
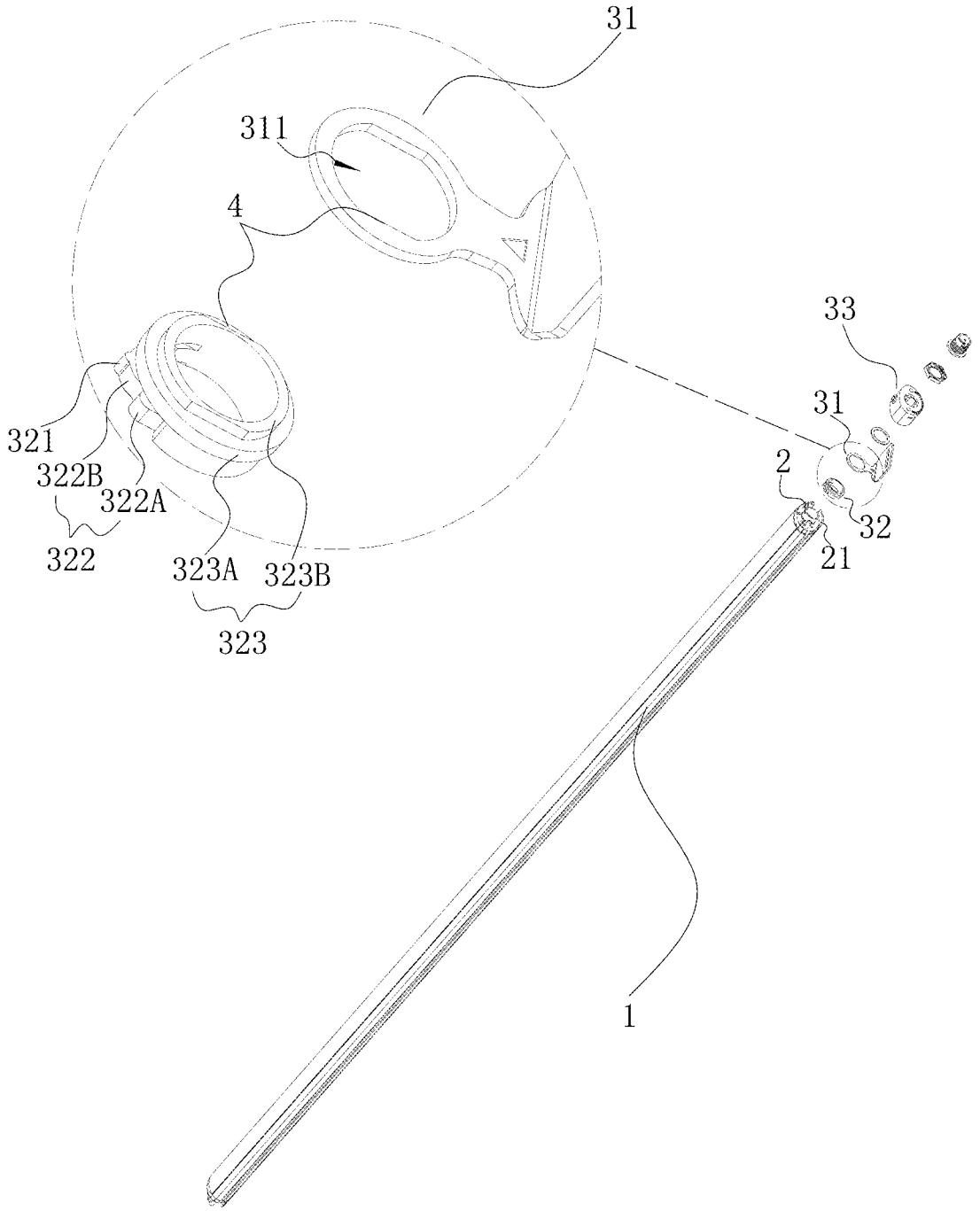
Figure 3:
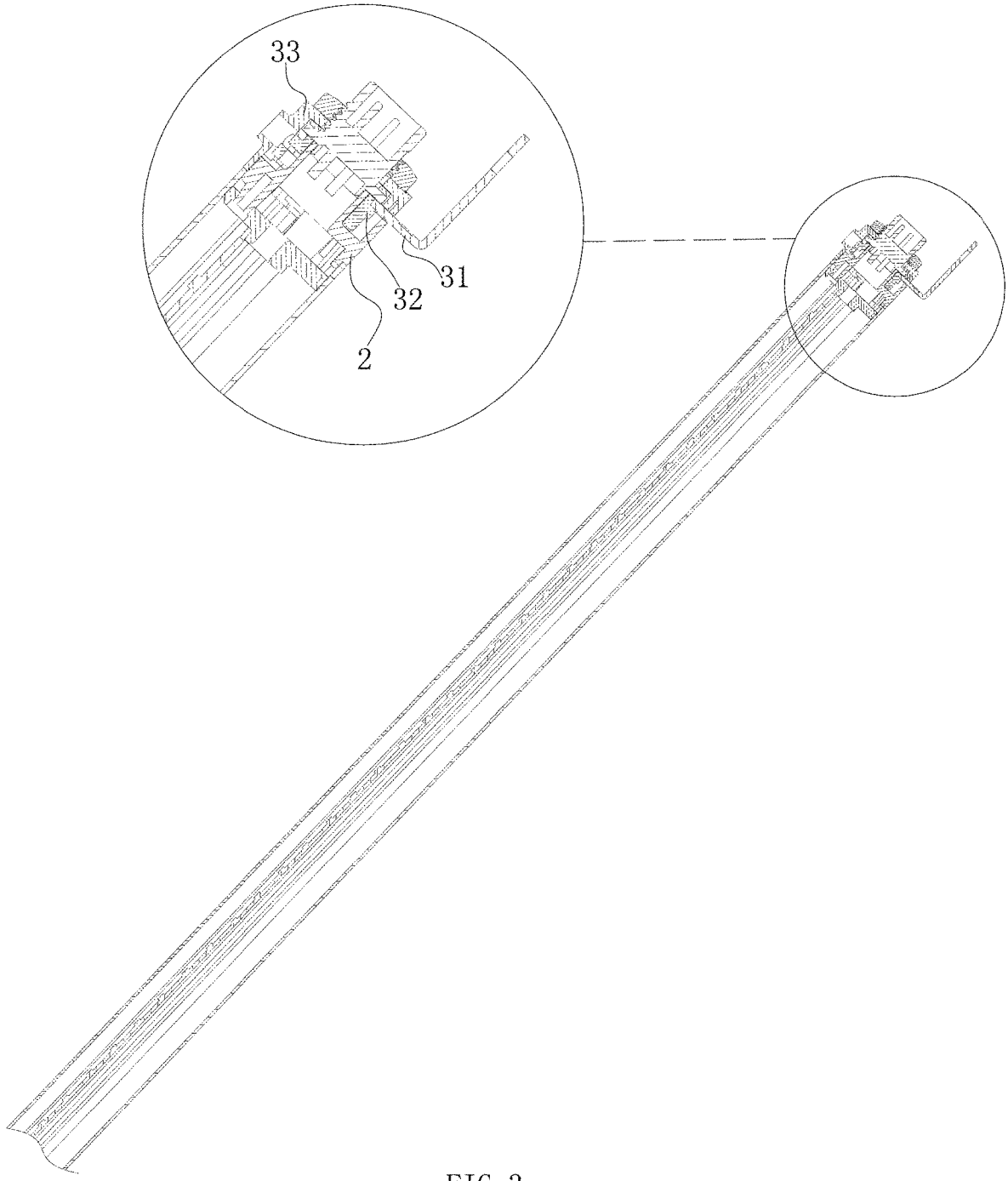
FIG. 3 is a sectional view of FIG. 1.

As shown in FIG. 1 and FIGS. 2(*a*)-2(*b*), the angle adjusting mechanism 3 is located at both ends of the lamp body 1, and the angle adjusting mechanism 3 is fixedly connected with the lamp body 1. When the illumination angle of the lamp body is to be adjusted, the operator can operate the angle adjusting mechanism 3 at both ends of the lamp body 1, the adjusting mechanism drives the lamp body 1 to rotate together, and after rotating to an expected angle, the lamp body 1 is maintained at the current angle by the cooperation inside the angle adjusting mechanism 3 to achieve adjustment purpose. The specific internal assembly structure of the angle adjusting mechanism 3 will be described below in detail, and for convenience of description, the following description will be made by taking only one end of the lamp as an example.

Figure 4:
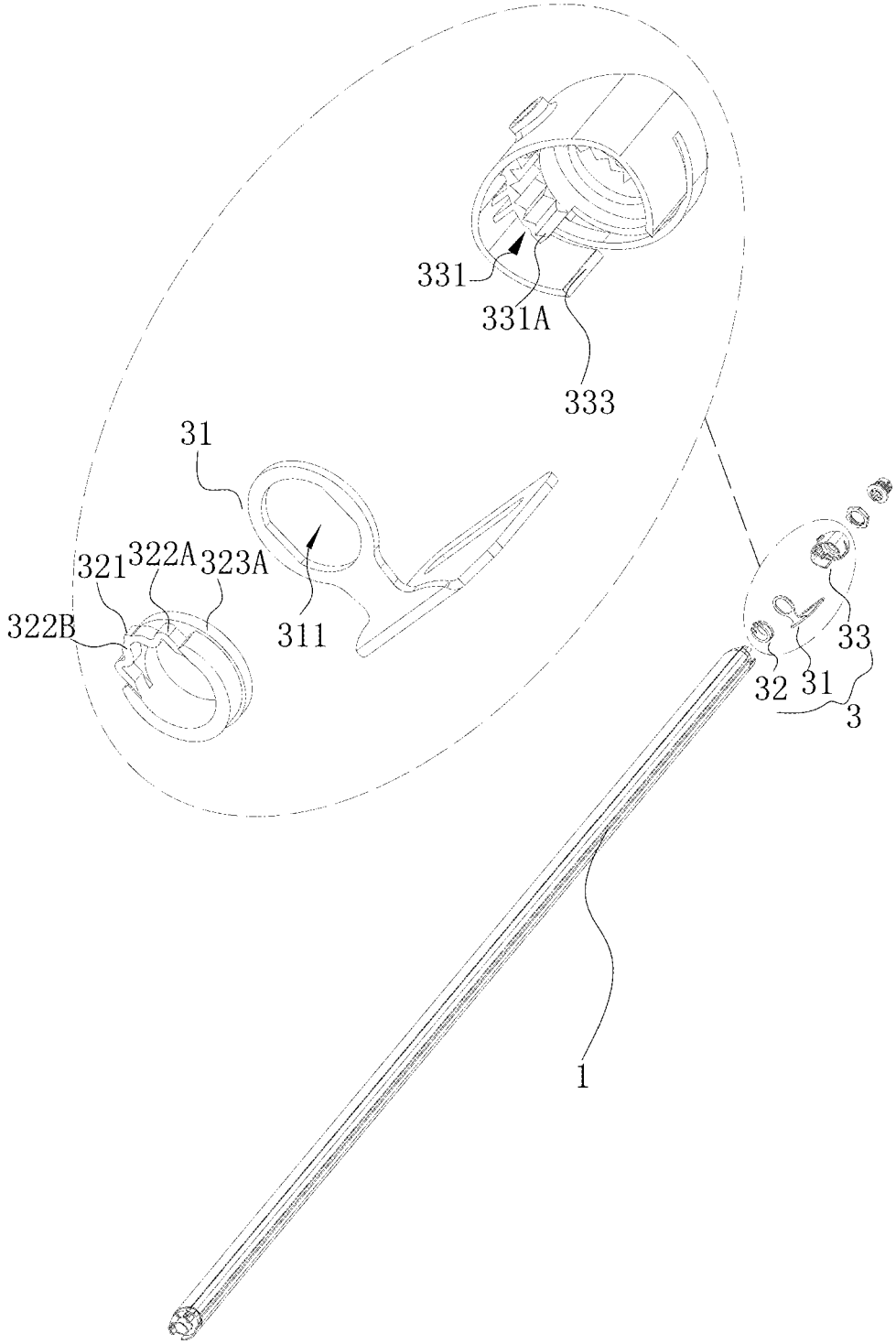
FIG. 4 is a schematic diagram view showing another angle structure of FIG. 2(*b*).

Referring to FIGS. 2(*a*)-2(*b*) and FIG. 4, the angle adjusting mechanism 3 comprises a mounting base 31 rotatable relative to the lamp body 1, an elastic piece 32 rotatable relative to the lamp body 1 with the mounting base 31, and an outer end cover 33. The mounting base 31 is sleeved on the threading cylinder 2, and the outer end cover 33 is arranged on the threading cylinder 2 and fixedly connected with the lamp body 1. The part of the mounting base 31 that is sleeved on the threading cylinder 2 and the elastic piece 32 are accommodated in the outer end cover 33, thereby improving the overall aesthetics of the lamp, as shown in FIG. 1. The outer end cover 33 and the lamp body 1 can be connected by screws, or connected in a manner that is convenient for fixing. The upper end surface of the elastic piece 32 is provided with a limiting part 321. Correspondingly, the inner wall of the outer end cover 33 is provided with a gear 331 which can cooperate with the limiting part 321 when the mounting base 31 moves relative to the lamp body 1 to make the lamp body remains at the current desired position. It should be noted that after the lamp body is installed, the angle is actually adjusted by rotating the outer end cover 33 and the lamp body 1 connected with the outer end cover 33; that is to say, during actual use, the lamp body 1, the outer end cover 33 and the gear 331 move relative to the elastic piece 32 and the mounting base 31. Correspondingly, the contact position between the limiting part 321 and the gear 331 is changed, and the limiting part 321 is re-locked between the teeth 331A of the gear 331 to prevent the rotation of the gear 331, thus maintaining the current angle adjusted. However, for convenience of description, the lamp body 1 and the outer end cover 33 are used as reference objects, and the mounting base 31 and the elastic piece 32 are rotated relative to the lamp body 1, but the two movement modes are substantially identical.

Specifically, the elastic piece 32 comprises a elastic piece body 322, an annular part 323 connected to the elastic piece body 322 and sleeved on the threading cylinder 2, and the mounting base 31 is sleeved on the periphery of the annular part 323. Specifically, in the present embodiment, as shown in FIG. 2(*b*), the annular part 323 is composed of a first annular part 323A with a diameter slightly larger than the outer diameter of the threading cylinder 2 and a second annular part 323BA integrally formed with the first annular part in the axial direction. The outer diameter of the second annular part 323B is smaller than the outer diameter of the first annular part 323A. The mounting base 31 is provided with a through hole 311 and sleeved with the periphery of the second annular part 323B through the through hole 311. The elastic piece body 322 is formed on a side of the first annular part 323A away from the mounting base 31.

In order to realize that the elastic piece can rotate synchronously with the mounting base relative to the lamp body, a braking part 4 is formed between the inner wall of the through hole 311 and the corresponding position of the periphery of the second annular part 323B. When the mounting base 31 rotates, the braking part 4 will act on the elastic piece 32 to make it move together with the mounting base 31. In the present embodiment, part of the inner wall of the through hole 311 is designed in plane, and the corresponding position of the periphery of the corresponding second annular part 323B is also designed in plane. The plane position of the inner wall of through hole 311 coincides closely with the plane position of the periphery of the second annular part 323B during assembling. When the mounting base 31 is rotated, the plane position on the periphery of the second annular part 323B generates a static friction force on the plane position of the inner wall of the through hole 311. According to the interaction of the force, the plane position of the inner wall of the through hole 311 also generates a static friction force on plane position of the periphery of the second annular part 323B, so that the annular part 323 will move under the action of static friction, that is, the elastic piece 32 rotates in the same direction as the mounting base 31. The design is simple in structure but also has good effects. It is obvious that the design of the braking part 4 is not limited to this manner, but other structures for the synchronous rotation of the mounting base 31 and the elastic piece 32 are also applicable, and the structural schematic view of the angle adjusting mechanism 3 after assembly can be seen in FIG. 3.

Of course, the elastic piece 32 can also be fixed to the mounting base 31 in other manners, for example, the elastic piece 32 is directly formed on the mounting base 31, on the condition that the relative integration of the elastic piece and the lamp can be achieved and the elastic piece of the existing technology is prevented from being easily slipped from the chute due to shaking and the like after it is placed in the chute, resulting in an inability to accurately coordinate with the gear for angle adjustment.

Referring to FIG. 4, the gear 331 formed on the inner wall of the outer end cover 33 has a plurality of teeth 331A. In order to better coordinate with the elastic piece and maintain the adjusting angle of the lamp body, the teeth 331A of the described gear 331 are formed along the axial direction of the lamp body 1 and circumferentially distributed on the inner wall of the outer end cover 33. When rotating the mounting base 31 to drive the elastic piece 32 to rotate together, the elastic piece 32 is deformed under the force. Under this influence, the limiting part 321 is disengaged from the current position in contact with the gear 331, and then meshes with the new teeth, and maintains in a new state.

In the present embodiment, in order that the elastic piece 32 can smoothly change the contact position between the teeth 331A of the gear 331 when rotating the mounting seat 31, the surface of the limiting part 321 of the elastic piece 32 is an arc surface. Referring to FIG. 2(*b*) together, the elastic piece body 322 comprises a smoothly transitioning curved surface 322A and an arched surface 322B smoothly connected to the curved surface 322A. The limiting part 321 is formed by the outward protrusion of the surface of the arched surface 322B. In the present embodiment, the limiting part 321 is of convex shape, but it is conceivable that, in order to better achieve the matching limit with the gear, the limiting part 321 can also be a convex strip shaped along the axial direction of the lamp body 1 and the convex strip has a smooth curved surface.

Continuously referring to FIG. 1 and FIG. 2(*b*), the lower part of the outer end cover 33 is formed with a penetrating strip groove 332 formed along the circumferential direction of the outer end cover 33, and the mounting base 31 is an L-shaped plate body. The lower end of the L-shaped plate body projects from the strip groove 332. The lower part of the threading cylinder 2 is formed with a curved plate 21, and the lower end surface of the housing 333 of the outer end cover 33 is not closed. When the outer end cover 33 is covered on the threading cylinder 2, the lower end surface of the housing 333 coincides with both end surfaces of the curved plate 21, thereby forming a complete closed surface to improve the overall aesthetics. Those are well known to those skilled in the art and not described in detail herein.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. An angle-adjustable lamp, comprising a lamp body (1), a threading cylinder (2) located at an end of the lamp body (1) and extending axially along the lamp body (1), and an angle adjusting mechanism (3), characterized in that:

the angle adjusting mechanism (3) comprises a mounting base (31) rotatable mounted on the threading cylinder (2) relative to the lamp body (1), an elastic piece (32) which can rotate synchronously with the mounting base (31) relative to the lamp body (1), and an outer end cover (33) which is arranged on the threading cylinder (32) and fixedly connected with the lamp body (1);

the upper end surface of the elastic piece (32) is provided with a limiting part (321), the inner wall of the outer end cover (33) is provided with a gear (331) which is matched with the limiting part (321) when the mounting base (31) rotates relative to the lamp body (1) to maintain the lamp body (1) at a required angle.

2. The angle-adjustable lamp as claimed in claim 1, wherein the elastic piece (32) comprises a elastic piece body (322), an annular part (323) connected to the elastic piece body (322) and sleeved on the threading cylinder (2), and the mounting base (31) is sleeved on the periphery of the annular part (323);

a braking part (4) is formed between the contact surfaces of the mounting base (31) and the annular part (323), and under the action of the braking part (4), the elastic piece (32) can rotate synchronously with the mounting base (31) relative to the lamp body (1).

3. The angle-adjustable lamp as claimed in claim 2, wherein the mounting base (31) is sleeved with the annular part (323) through a through hole (311) arranged thereon, the inner wall of the through hole (311) is partially planar, and the corresponding position of the periphery of the annular part (323) is correspondingly planar and the plane of the inner wall of the described through hole (311) is fitted to the plane of the periphery of the annular part (323) to form the braking part (4).

4. The angle-adjustable lamp as claimed in claim 1, wherein the teeth (331A) of the gear (331) are formed along the axial direction of the lamp body (1) and circumferentially distributed on the inner wall of the outer end cover (33).

5. The angle-adjustable lamp as claimed in claim 1, wherein the surface of the limiting part (321) of the elastic piece (32) is an arc surface.

6. The angle-adjustable lamp as claimed in claim 2, wherein the elastic piece body (322) comprises a smoothly transitioning curved surface (322A) and an arched surface (322B) smoothly connected to the curved surface (322A), and the limiting part (321) is formed by the outward protrusion of the surface of the arched surface (322B).

7. The angle-adjustable lamp as claimed in claim 1, wherein the lower part of the outer end cover (33) is formed with a penetrating strip groove (332) formed along the circumferential direction of the outer end cover (33), and the mounting base (31) is an L-shaped plate body, and the lower end of the L-shaped plate body projects from the strip groove (332).

8. The angle-adjustable lamp as claimed in claim 1, wherein the lower part of the threading cylinder (2) is formed with a curved plate (21), the lower end surface of the housing (333) of the outer end cover (33) is not closed, and when the outer end cover (33) is covered on the threading cylinder (2), the lower end surface of the housing (333) coincides with both end surfaces of the curved plate (21) to form a complete closed surface.

* * * * *